US008757406B2

(12) United States Patent
Brown et al.

(10) Patent No.: US 8,757,406 B2
(45) **Date of Patent: *Jun. 24, 2014**

(54) FULLY VENTED WIDE RIM NURSING BOTTLE

(75) Inventors: Craig E. Brown, Mt. Zion, MO (US); Robert J. Brown, Chesterfield, MO (US)

(73) Assignee: New Vent Designs, Inc., Chesterfield, MO (US)

( * ) Notice: Subject to any disclaimer, the term of this patent is extended or adjusted under 35 U.S.C. 154(b) by 203 days.

This patent is subject to a terminal disclaimer.

(21) Appl. No.: 12/925,465

(22) Filed: Oct. 22, 2010

(65) Prior Publication Data

US 2011/0068078 A1 Mar. 24, 2011

Related U.S. Application Data

(63) Continuation-in-part of application No. 12/807,013, filed on Aug. 26, 2010, now Pat. No. 8,579,130, which is a continuation of application No. 12/072,465, filed on Feb. 26, 2008, now abandoned, which is a continuation of application No. 12/002,468, filed on Dec. 17, 2007, now Pat. No. 7,828,165, and a continuation of application No. 11/258,966, filed on Oct. 26, 2005, now abandoned.

(51) Int. Cl.
*A61J 9/04* (2006.01)

(52) U.S. Cl.
USPC ..... 215/11.4; 215/11.1

(58) Field of Classification Search
USPC ..... 215/11.1, 11.4
See application file for complete search history.

(56) References Cited

U.S. PATENT DOCUMENTS 189,691 A 4/1877 Briere
345,518 A 7/1886 LeLievre
(Continued)

FOREIGN PATENT DOCUMENTS

DE 19601198 1/1996
GB 273185 6/1927
(Continued)

*Primary Examiner* — Tri Mai
(74) *Attorney, Agent, or Firm* — Paul M. Denk

(57) ABSTRACT

A nursing bottle (1) formed of a large volume container, incorporating a vent tube (3) that extends inwardly of the container, having a vent port (4) arranged approximately at the volumetric midpoint (12) of the container, so as to allow for venting of pressure, whether of excessive or vacuum, to the atmosphere, at all times. The volumetric capacity of the nursing bottle container may be formed of a spherical shape (1), hemispherical shape (40), cylindrical shape (18), or to other configurations that provide for the internal volumetric capacity so that any formula placed therein will be prevented from blocking the vent port (4), the vent tube (3), regardless of the angular disposition undertaken by the nursing bottle during usage. The vent tube (10), with its disposed vent port (12), may either extend upwardly within the container, or extend downwardly (3) from its connection with the vent insert (7), operatively associated with a collar (6), that holds both the vent structures and the nipple (5) to the wide rimmed opening (19) for these type containers. In addition, as an alternative, the vent tube may be integrally formed, or connected by a flange, through the surface of the nursing bottle container, either at its bottom (14), or along a side (74), and either extend upwardly, or obliquely radially inwardly (82), so as to dispose its vent port (84) at that desired location approximately at the volumetric midpoint of the nursing bottle.

3 Claims, 10 Drawing Sheets

(56) References Cited

U.S. PATENT DOCUMENTS

| | | | | |
|---|---|---|---|---|
| 380,835 | A | | 4/1888 | Ware |
| 598,231 | A | | 2/1898 | Roderick |
| 679,144 | A | | 7/1901 | Hardesty |
| 834,014 | A | | 10/1905 | Lyke |
| 927,013 | A | | 7/1909 | Van Cleave |
| 976,607 | A | | 12/1910 | Van Cleave |
| 1,037,309 | A | | 9/1912 | Poore |
| 1,441,623 | A | | 1/1923 | Davenport |
| 1,600,804 | A | | 9/1926 | Donaldson |
| 2,014,236 | A | | 9/1935 | McNamara |
| 2,061,477 | A | | 11/1936 | Perry |
| 2,156,313 | A | | 5/1939 | Schwab |
| 2,239,275 | A | | 4/1941 | Schwab |
| 2,365,585 | A | | 12/1944 | Paxman |
| 2,610,755 | A | | 9/1952 | Gits |
| 2,742,168 | A | | 4/1956 | Panetti |
| 2,744,646 | A | | 5/1956 | Blackstone |
| 3,059,797 | A | | 10/1962 | Wilkinson et al. |
| 3,112,837 | A | | 12/1963 | Manoylan |
| 3,120,330 | A | | 2/1964 | Ermecke |
| 3,235,133 | A | | 2/1966 | Zimmerman et al. |
| 3,254,809 | A | | 6/1966 | Breneman |
| 3,355,047 | A | | 11/1967 | DeSole |
| 4,386,696 | A | | 6/1983 | Goncalves |
| 4,722,463 | A | | 2/1988 | Anderson |
| 4,757,911 | A | | 7/1988 | Larkin et al. |
| 4,930,645 | A | | 6/1990 | Warehime |
| 5,054,660 | A | | 10/1991 | Sherman et al. |
| 5,269,444 | A | | 12/1993 | Wright |
| 5,284,262 | A | | 2/1994 | O'Nan |
| 5,316,160 | A | | 5/1994 | Cautereels |
| 5,352,052 | A | | 10/1994 | Kaufmann |
| 5,449,098 | A | | 9/1995 | Offman |
| 5,570,796 | A | | 11/1996 | Brown et al. |
| 5,678,710 | A | | 10/1997 | Sheu |
| 5,749,483 | A | * | 5/1998 | Tebeau ..... 215/11.4 |
| 5,779,071 | A | | 7/1998 | Brown et al. |
| 5,953,763 | A | | 9/1999 | Gouget |
| 6,793,094 | B2 | | 9/2004 | Turnbough |
| 7,150,370 | B2 | | 12/2006 | Pyun |
| 7,828,165 | B2 | * | 11/2010 | Brown et al. ..... 215/11.4 |

FOREIGN PATENT DOCUMENTS

| | | |
|---|---|---|
| GB | 454053 | 9/1936 |
| SE | 82001470 | 1/1982 |

* cited by examiner

FULLY VENTED WIDE RIM NURSING BOTTLE

CROSS REFERENCE TO RELATED APPLICATION

This continuation-in-part claims priority to the continuation patent application having Ser. No. 12/807,013, filed Aug. 26, 2010, which claims priority to the continuation patent application having Ser. No. 12/072,465, filed Feb. 26, 2008, which claims priority to the continuation patent application having Ser. No. 12/002,468, filed Dec. 17, 2007, now U.S. Pat. No. 7,828,165, which claims priority to the continuation patent application having Ser. No. 11/258,966, filed on Oct. 26, 2005; which claims priority to the nonprovisional patent application having Ser. No. 10/283,878, which was filed on Oct. 30, 2002, which claims priority to the PCT International patent application having Serial No. PCT/US01/14365, which was filed on May 4, 2001, which claims priority to the provisional patent application having Ser. No. 60/202,851, which was filed on May 8, 2000.

BACKGROUND OF THE INVENTION

This invention relates generally to a nursing bottle, that incorporates enhanced features and parameters that provide for its full venting during both usage and storage.

Nursing bottles of a multitude of designs are available in the prior art. In many instances, as is well known in the art, frequently a vacuum will be generated within the bottle during dispensing of its contents, as when nursing the infant, and which is believed can cause various physiological impairments to the child when subjected to this type of condition over prolonged feedings. It is theorized that the vacuum generated within the bottle, due to the infant's sucking, can cause pressure imbalance at the location of various features of the body, such as in the ear canal, or perhaps elsewhere, and which may possibly lead to the generation of infection, illness, or other predicaments. Thus, the presenting of a nursing bottle that incorporates air venting means, so as to prevent the creation of a vacuum inside the bottle, has been considered a desirable development in the field of infant serving products. Such can be seen in the applicants' prior U.S. Pat. No. 5,779,071 and U.S. Pat. No. 5,570,769, wherein the reservoir tube that provides for venting, externally of the bottle cap, at an upper proximity, extends into the lower portion of the container, to function as a vent while the contents of the bottle are being consumed, when partially or fully inverted.

Other attempts have been made to provide a nursing bottle with an air vent, to enable the ambient air to enter the container during usage, and to dilute or prevent the generation of any vacuum. For example, the United States patent to Roderick, U.S. Pat. No. 598,231, discloses one such nursing bottle with a U-shaped air tube. Other patents show related types of technology, and provide means for venting air from the interior of its shown container, as can be seen in the United States patent to Van Cleave, U.S. Pat. No. 927,013. In addition, the patent to Davenport, U.S. Pat. No. 1,441,623, in addition to the prior patent to Perry, U.S. Pat. No. 2,061,477, show other means for venting of air from within a nursing bottle.

The current invention, on the other hand, provides means for venting of any air pressure within the bottle, and to prevent the generation of any vacuum or pressure therein, regardless whether the nursing bottle is being used, stored in an upright position, or partially or fully inverted as during consumption of its contents.

Other United States patents that relate to the subject matter of this invention include the United States patent to Briere, U.S. Pat. No. 189,691; U.S. Pat. No. 345,518, to Lelievre; U.S. Pat. No. 679,144, to Hardesty; U.S. Pat. No. 834,014, to Lyke; U.S. Pat. No. 1,600,804 to Donaldson; U.S. Pat. No. 2,156,313, to Schwab; U.S. Pat. No. 2,239,275, to Schwab; U.S. Pat. No. 2,610,755, to Gits; U.S. Pat. No. 2,742,168, to Panetti; U.S. Pat. No. 2,744,696, to Blackstone; U.S. Pat. No. 3,059,707, to Wilkinson, et al; U.S. Pat. No. 5,570,796, to Brown, et al. In addition British patent No. 273,185; and, British patent No. 454,053, show related development.

SUMMARY OF THE INVENTION

This invention contemplates the establishment of a structured relationship between the container or vessel that holds the formula for a nursing bottle, having sufficient size so that as the formula is prepared and deposited within the container, its surface will be arranged below the vent port or the vent leading towards the exterior of the container, for venting purposes, and in addition, even when the vessel is inverted, by the infant or parent, during feeding, the liquid formula still will be maintained at a surface level below the vent port, but in this case, when in the inverted condition. Thus, the concept of this invention is to provide a container with sufficient bulk and volume, so that the formula or milk as supplied therein, whether it be in the four ounce, six ounce, eight ounce, plus category, will always leave the identified vent port exposed to attain the attributes of venting, for the nursing bottle, at all times.

Thus, no appreciably positive or negative pressure can build up in the container, since the vent port will be opened, for exhausting purposes, when the nursing bottle is maintained in an upright direction, as while it is being warmed or heated, in preparation for a feeding, and even while the bottle may be inverted, as during a feeding, so as to allow for the venting of any reduced pressure, internally generated within the container, that may occur as a result of the sucking action of the infant, during feeding.

This feature of providing sufficient internal volumetric size to the container is achieved through usage of containers that are of excessive dimensions, such as being large and spherical in shape, or cylindrical in shape and flattened upon each surface, or which has a size equivalent to that of a Mason jar. In one instance, the container may be shaped in a spherical form. In another embodiment, the container will be of a cylindrical shape, but be flattened or pancacked on the sides, as can be understood. In a further embodiment, the container may be of the jar shape, or even contain some concavity upon its sides, to facilitate its lifting. In addition, where the spherical or cylindrical type of container is used, it may have a flattened bottom, to add stability to the nursing bottle, when rested upon a surface.

In the preferred embodiment, the venting port cooperates with a vent tube, and lateral vent slots, that are built into the insert that is secured to the top of the container by means of its associated threaded collar, that holds both the vent tube within the vessel, and the conventional nipple, in place. The vent port associated with the vent tube may open directly, downwardly into the vessel, or it may have said lateral ports, to either side, so as to prevent the entrance of any formula, into the vent tube, as the container is being inverted during usage, but still allow the necessary venting.

In a further embodiment, the container, collar, and nipple may be of the conventional type, but having the volumetric sizes from the shaped containers as previously explained, but the vent tube and port may extend through the surface of the container, rather than cooperate with the collar, in the manner as previously described in U.S. Pat. No. 5,779,071.

Nevertheless, the orientation of the vent port, at its entrance point, leading to the vent tube, will normally be arranged somewhere centrally of the configured container, regardless what shape or structures the containers may possess, so as to allow the formulation to either be below the vent port, or above it, as the nursing bottle is either at rest, or being inverted as during usage, in the manner as previously explained.

Thus, it is the principal object of this invention to provide a volumetric sized container for use as a nursing bottle, and which incorporates a vent tube with vent port that is arranged approximately centrally thereof, so that the vent port avoids coverage from any of the formula or milk contained therein, either during usage when feeding the infant, or during non-usage when the bottle has been set on its base, as during storage, while heating, or when at rest.

A further object of this invention is to provide for structure means within a nursing bottle that provides for continuous venting of any pressure or vacuum generated within its container, regardless of usage or nonusage of the subject bottle.

Still another object of this invention is to provide for the structure of a wide rimmed collar for use with a standard wide mouth container as structured into a nursing bottle, and useful for feeding formula to an infant.

These and other objects may become more apparent to those skilled in the art upon review of the summary of the invention as provided herein, and upon undertaking a study the of the description of its preferred embodiment, in view of the illustrated drawings.

BRIEF DESCRIPTION OF THE DRAWINGS

In referring to the drawings.

The same reference numerals refer to the same parts through out the various figures.

DESCRIPTION OF THE PREFERRED EMBODIMENT

Figure 1:
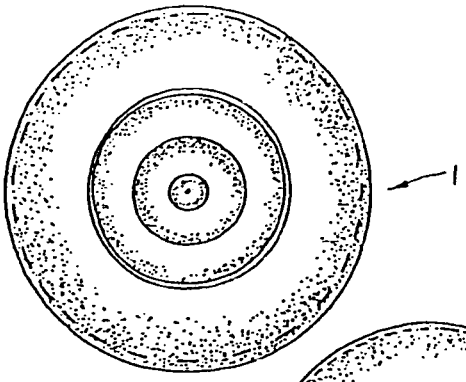
FIG. 1 is a top view of a spherical shaped nursing bottle.
Figure 2A:
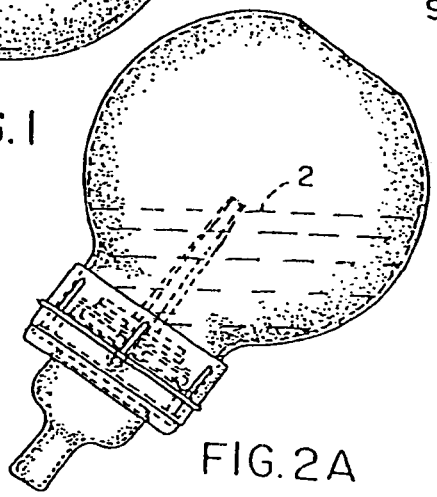
FIG. 2A is a side view of the bottle during usage.
Figure 2:
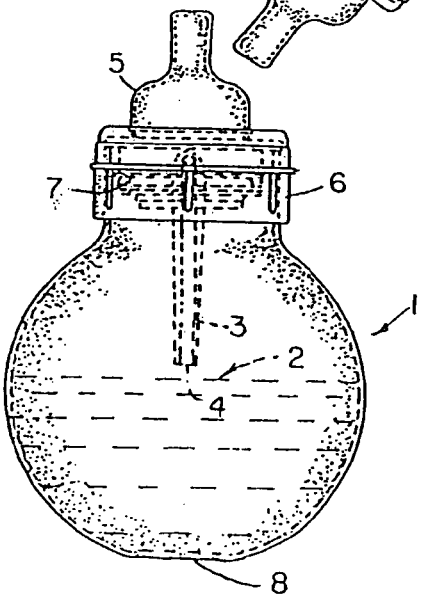
FIG. 2 is a side view thereof.

In referring to the drawings, and in particular FIGS. 1 and 2, the fully vented, wide rim nursing bottle of this invention is disclosed. It includes a spherical shaped container 1 that has ample volumetric capacity therein, so as to achieve the sought after results for this invention. That is, when a formula, such as at 2, is applied into the container, with the formula being applied at an amount that normally furnishes a feeding for the infant, it will only fill the container up to a level that is yet below the bottom of the vent tube 3, and more specifically its vent port 4, as can be noted.

Thus, when the nursing bottle is being heated, and should any pressure build up within its container, it will be immediately vented to the atmosphere, because of the openness of the vent port 4, to absorb any generated pressure, no matter how slight, and allow it to be vented to the atmosphere, externally of the shown nursing bottle. The nipple 5, the threaded collar 6, and the vent insert 7, that are threadedly applied to the upper edge of the container 1, are all fabricated in the manner as previously described in the U.S. Pat. No. 5,779,071, with the exception that these components are fabricated of a wider dimension, so as to fit upon a wide rim style of opening for the shown container 1, thereby providing the type of ample volumetric capacity for the nursing bottle, even though the standard size of nipple may be employed, to achieve the relationship between its structure, such as the vent port, and the level of any standard amount of formulation applied therein, during usage, to achieve the benefits of this invention. In addition, when the nursing bottle of this invention is applied, for feeding an infant, and is inverted, the formulation may rise to the opposite side of the inverted container 1, but yet will have a surface level that will still be below the vent port 4, so that any sucking action generated by the infant, during feeding, and the formation of any vacuum, or partial thereof, within the container, during feeding, will be continuously vented by its vent port 4, through the vent tube 3, and out of the vent insert 7, as previously reviewed.

It should be noted that the container 1 of this invention will obviously include a minor flattened surface, as at 8, at its bottom, in order to facilitate the free standing of this nursing bottle, as when not in use, when stored, or when being warmed or heated in preparation for consumption of its formulated content.

FIG. 2A shows the container 1 and its nursing bottle when inverted, as during a feeding, to disclose how the fluid level 2 will yet remain below the opened vent port 4, so as to not obstruct the venting of any partial vacuum generated therein, during the feeding process.

Figure 3:
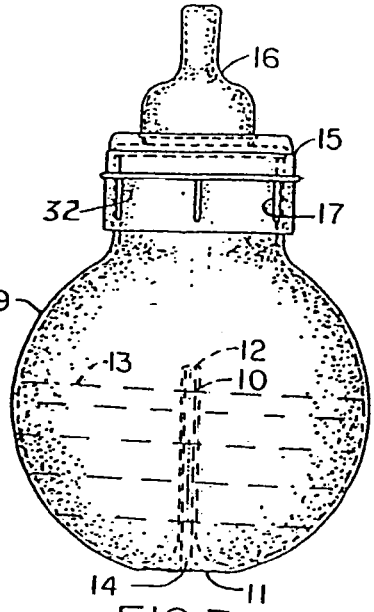
FIG. 3 shows a modification to a spherical shaped nursing bottle wherein the vent tube extends structurally upwardly from its bottom.
Figure 4:
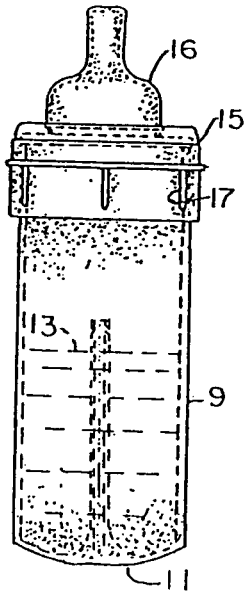
FIG. 4 is a side view of the nursing bottle of FIG. 3.

FIGS. 3 and 4 disclose a modification to the shape of the container 9 for the shown nursing bottle, with the further modification that the vent tube 10 will be integrally structured with the bottom 11 of the shown container, disposing its vent port generally centrally of the container, as can be noted at 12. Thus, regardless at what position the container 9 of this nursing bottle may undertake, the surface level 13 of the formula will not obstruct the entrance of any generated vacuum or pressure into the vent port 12, for venting purposes, in this case, out of the bottom opening 14 of the shown vessel. This is so regardless whether the container 9, as during storage, or feeding, may be positioned vertically, as shown in FIG. 3, or inverted, as can be understood. In this particular instance, the threaded collar 15 and nipple 16 are conventional, and threadedly engage to the wide rim 17 of the container 9, in order to enhance the volumetric capacity of the nursing bottle, during usage, and to attain the results desired and required for this particular development. In addition, as can be seen in FIG. 4, the structure of wide rim container 9 is generally spherical, as can be noted in FIG. 3, but flattened on its front and back surfaces, as disclosed in FIG. 4, and yet attains the volumetric capacity for the formula, as desired and required for this development.

Figure 5:
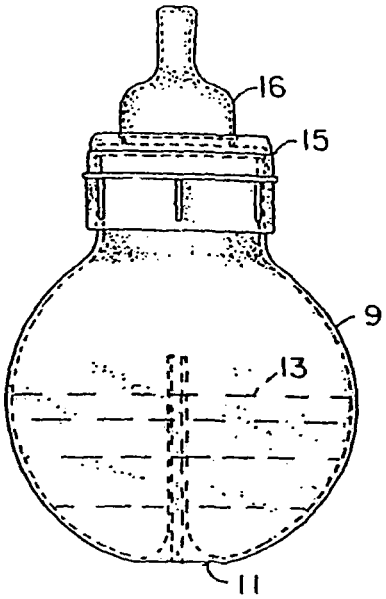
FIG. 5 is a back view of the nursing bottle of FIG. 3.
Figure 6:
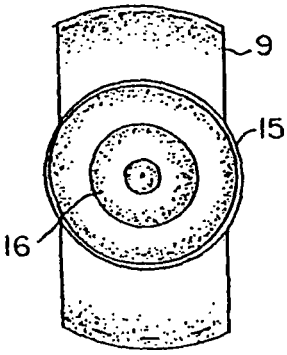
FIG. 6 is a top view thereof.
Figure 11:
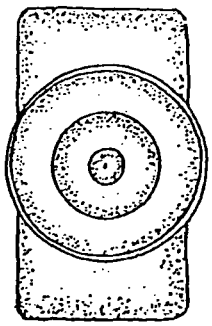
FIG. 11 is a top view thereof.
Figure 12:
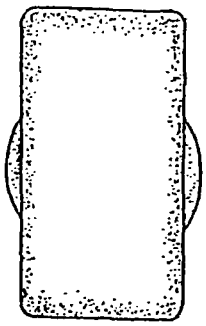
FIG. 12 is a bottom view thereof.
Figure 10:
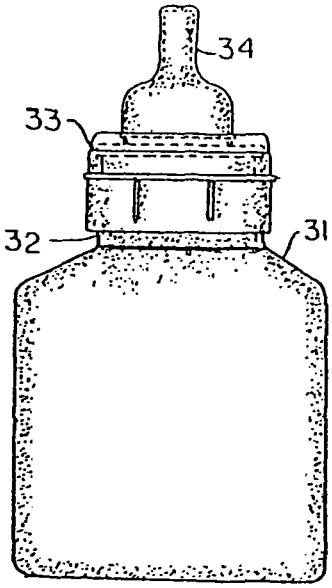
FIG. 10 is a front view of a wide structured nursing bottle of a rectangular configuration having its collar and nipple applied to a wide rim at its upper end.

FIGS. 5 and 6 provide both a back view, and top view, of the modified nursing bottle as previously described in FIGS. 3 and 4.

Figure 7:
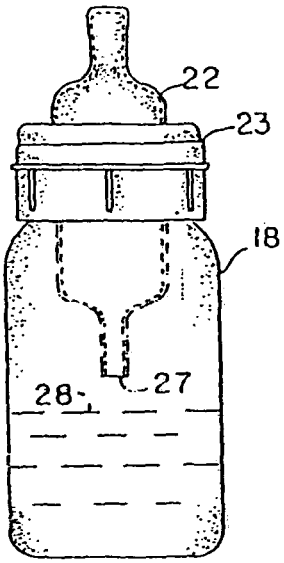
FIG. 7 is a side view of a modified form of nursing bottle having a wide rim configuration for mounting of its collar and nipple, and supporting the vent structure therein.
Figure 9:
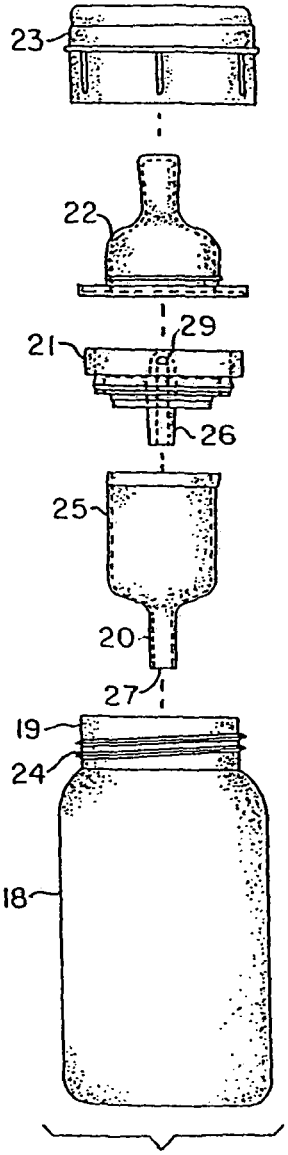
FIG. 9 is an exploded view of the operative components of the structured nursing bottle as shown in FIG. 7.
Figure 8:
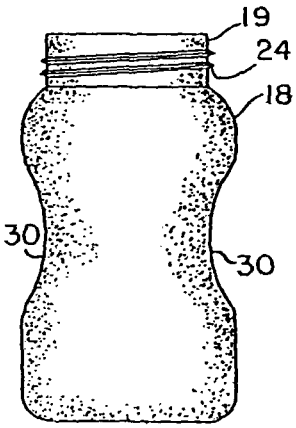
FIG. 8 is a side view of the container for the nursing bottle as shown in FIG. 7.

FIGS. 7 through 9 show a further modified nursing bottle of this invention, wherein its container 18 has a Mason jar style of configuration, thereby affording the wide rimmed 19 style of opening, at its upper end, for accommodating the vent tube 20, receptacle portion 25, the vent insert 21, the nipple 22, and the threaded collar 23, that all threadedly engage onto the threads 24 of the shown container. These components 20 through 23 and 25 are very similar in structure to that as previously described in U.S. Pat. No. 5,779,071, with the exception that the components are fabricated to a wider dimension, in order to be accommodated upon the wide rimmed opening 19 of the shown container 18. The vent tube communicates with its upper inner receptacle portion 25, forming the reservoir-like configuration as noted, and which positions thereon and locates therein the internal vent tube 26 of the vent insert 21, to function in the manner as previously explained in said earlier patent. But in this particular instance, it should be noted that the vent port 27 of the vent structure, as all mounted to the wide rim of the volumetric container 18, when inserted, is disposed approximately at the center of the internal space of the shown container 18, in order to achieve the benefits and results as explained for this invention. Hence, the surface level 28 of the formula applied therein will always be below the entrance to the vent port 27, so as to avoid its blockage, regardless whether the container 18 is maintained in its rest position, as shown in FIG. 7, or when the container is tilted to any angulation, or should it be inverted, placed on its side or any position, as during the feeding process. This allows the reduced pressure generated within the container, during feeding with the nursing bottle, to always be vented, to the atmosphere, as can be understood. In addition, it is to be noted, particularly upon review of U.S. Pat. No. 5,779,071, that wherever these vent tube and vent insert configurations are inserted upon the wide rim and held in position by means of the collar 23, that the vent tube 26 internally communicates with the lateral vent passages 29 and opens to atmosphere internally of the collar 23, to provided venting thereof, at all times, to achieve the purposes and advantages of this invention.

It can also be noted in FIG. 8 that the sides of the container 18 may be integrally concaved, as at 30, in order to facilitate the gripping and holding of the larger sized bottle, during its usage.

FIGS. 10 through 13 disclose a larger volumetric sized nursing bottle, having a container 31 that is generally of a rectangular configuration. It has a wide rimmed opening, as at 32 for accommodating the shown collar 33, its supported nipple 34, the vent tube 35, and the vent insert 36 when installed. The vent insert is shown more carefully in FIGS. 14 and 15, and it can be seen that the bottom of the vent port 37 is closed, and venting is achieved through the lateral port 38 that extends to the front and back of the vent tube, to attain venting from internally of the shown container. In addition, the lateral port 38 is arranged approximately at the volumetric midpoint of the bottle. In addition, the purpose of the lateral vents 38 is to prevent the entrance of any of the formula 39 therein, as when the nursing bottle is inverted, as during a feeding.

Figure 13:
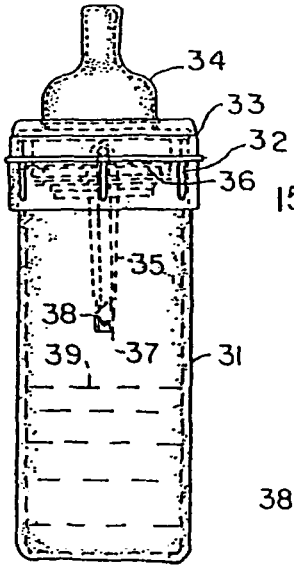
FIG. 13 is a side view thereof, and showing its internal venting structure.
Figure 14:
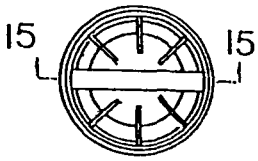
FIG. 14 is a top view of the vent insert applied within the collar when affixed to the wide rim of the container of the nursing bottle as shown in FIG. 13.
Figure 15:
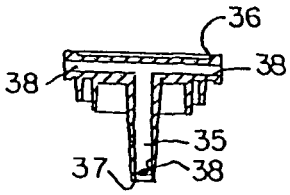
FIG. 15 is a sectional view of the vent insert, taken along the line 15-15 of FIG. 14.

Nevertheless, as can be seen in FIG. 13, the level of the formula will always be at a location spaced from the bottom of the vent tube 35, to attain the purposes of this invention. Furthermore, as can be seen in FIG. 15, and as noted from our prior patents, the vent insert 36 has the lateral vents 38 that communicate with the vent 35, for allowing the discharge of any vacuum, pressure, or the like, generated within the nursing bottle during usage, to the atmosphere, externally of the bottle, in order to achieve the benefits and results of this development.

Figure 16:
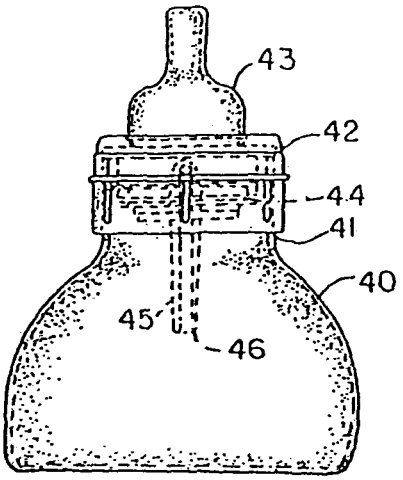
FIG. 16 is a front view of a nursing bottle having a volumetric structured vessel with the collar, vent insert and nipple applied to its wide rim top, for disposing its vent tube, and vent port approximately centrally of its shown container.

FIG. 16 shows a nursing bottle that incorporates a semi-spherical container 40, and having mounted onto its integral wide rim 41 the collar 42, nipple 43, and the vent insert 44 as noted. In addition, the vent tube 45 extends downwardly into the container 40, with the bottom 46 of the vent tube being arranged approximately, once again, at the approximate midpoint of the volumetric capacity of the nursing bottle, to achieve the benefits of this invention.

Figure 17:
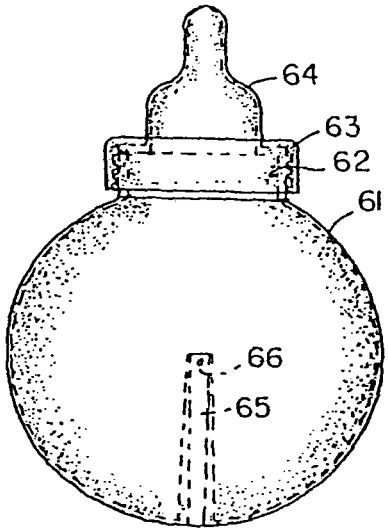
FIG. 17 is a front view of another spherical form of container for a nursing bottle having the vent tube operatively structured and disposed with its bottom segment.

FIG. 17 discloses a spherical form of nursing bottle wherein its container 61 has mounted to its wide rim 62 by threaded engagement the collar 63 and the nipple 64, as noted.

The vent tube, in this instance, as at 65, extends integrally upwardly from the bottom of the container 61, and internally is vented to the atmosphere, out the bottom of the bottle, and has at its upper end the lateral vent ports 66 as noted. Again, these vent ports are arranged at the approximate midpoint of the volumetric capacity for the shown container, to achieve the benefits of this invention.

Figure 18:
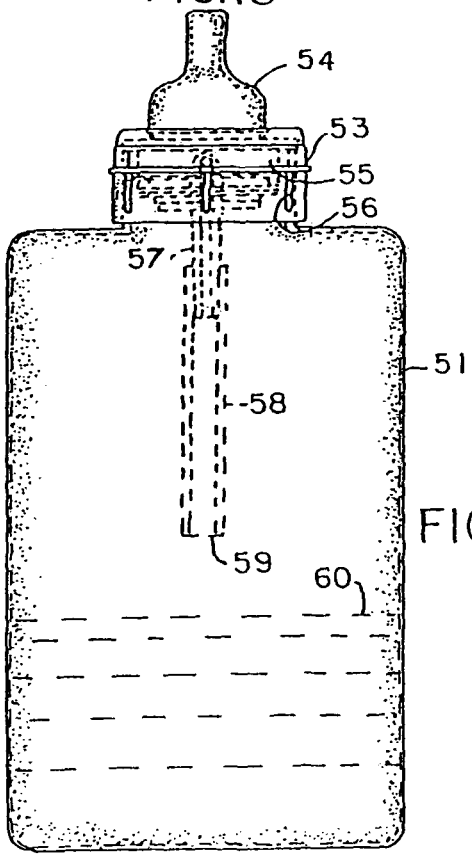
FIG. 18 is a front view of a further rectangularly shaped volumetric sized container for a nursing bottle having the collar, vent insert, and vent tube all operatively associated therewith.
Figure 19:
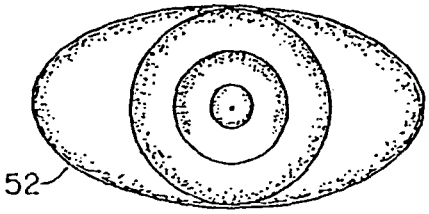
FIG. 19 is a top view of a further modified wide rim nursing bottle of this invention.

FIGS. 18 and 19 disclose a modification to the nursing bottle of this invention, wherein its container 51 is generally rectangular of configuration in one dimension, but has an oval shape 52 along its vertical disposition. Its collar 53 supports the nipple 54, and the vent insert 55 to the wide rim 56 of the integral container 51, for the nursing bottle. The vent tube 57 of the insert extends downwardly, and includes an extended vent tube 58, whereby its vent port 59 at its bottom end is disposed approximately, once again, at the volumetric midpoint of the shown container 51 for the nursing bottle. Thus, any formula 60 contained therein, and processed for feeding, will always be below the disposition of the vent port 59, regardless whether the nursing bottle is rested upright, as shown in FIG. 18, or inverted, as during the feeding process.

Figure 20:
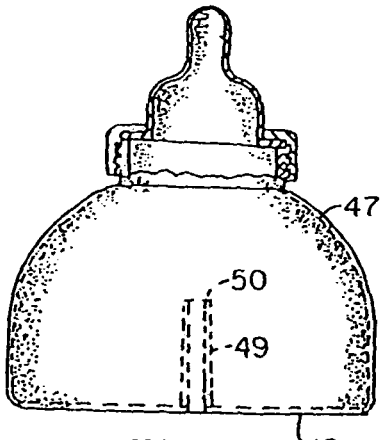
FIG. 20 is a front view thereof.

FIG. 20 shows a similar style of nursing bottle, to that of FIG. 16, but in this instance, its container 47 has integrally formed of its flattened bottom 48 an upwardly extending vent tube 49, whose upper end 50, forming the vent port, is arranged once again at the approximate volumetric midpoint of its shown container.

FIGS. 21 through 25 show variations upon the arrangement of the vent tube of this invention. As noted, in FIG. 21 the shown nursing bottle has its container 67 mounting upon its wide rim 68, its threaded collar 69, and the shown nipple 70. For venting purposes, in this particular embodiment, the vent tube 71 is integrally formed of the container 67, and extends radially inwardly, along an oblique angle, into the approximate midpoint of the shown container, having its vent port 72 disposed approximately at this location, as noted.

Thus, any formula 73 provided therein, and particularly of the standard amount normally fed to an infant, will always be below the entrance to the vent port 72, and not cause any blockage thereof. This is so regardless whether the nursing bottle is being stored, or inverted as during usage, as can be understood.

Figure 22:
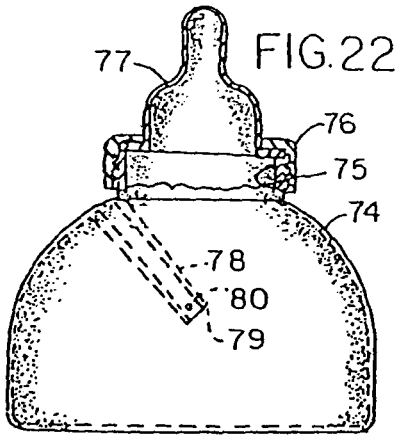
FIG. 22 is a further modified wide rim nursing bottle having its oblique vent tube extending inwardly from the approximate upper surface of its container.

FIG. 22 shows the semispherical style of container 74 for the shown nursing bottle. The bottle has a wide rim 75, and to which the threaded collar 76 and the nipple 77 are attached.

Figure 21:
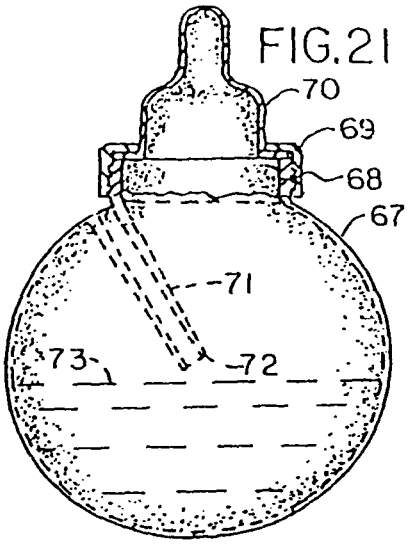
FIG. 21 is a further modified wide rim nursing bottle of this invention having its vent tube extending inwardly towards centrally from the upper container surface.

In this instance, similar to that of the bottle as described in FIG. 21, the vent tube 78 is integrally formed of the container, and is arranged obliquely within it, to dispose its vent port, as at 79, and more specifically its lateral vents 80, internally at the approximate volumetric midpoint of the shown container, to achieve the benefits of this invention.

Figure 23:
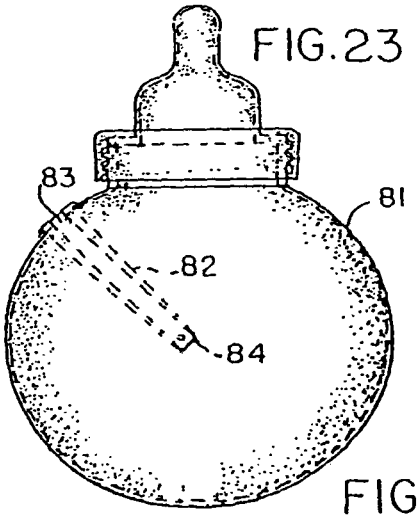
FIG. 23 is a further modified wide rim nursing bottle having the vent tube extending inwardly from the surface of its container.

FIG. 23 is similar to the structured nursing bottle as described in FIG. 21, but in this instance, as can be noted, the container 81 has its vent tube 82 arranged further down the side of the shown container, opening to atmosphere as at 83, and having its vent port 84 provided at the approximate midpoint of the shown container 81.

Figure 24:
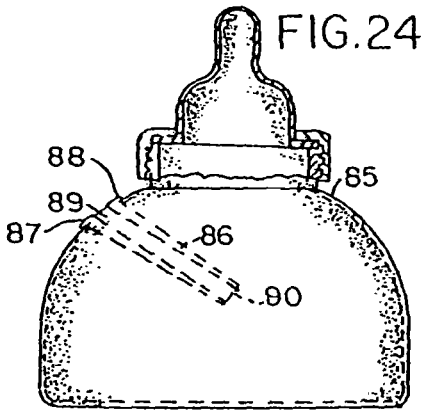
FIG. 24 is similar to the bottle of FIG. 22, with the vent tube structured further downwardly along the side of the shown bottle.

FIG. 24 shows a structure for a nursing bottle similar to that as previously explained in FIG. 22, but in this particular instance, the container 85 has its vent tube 86 integrally formed further down the side of the shown container, as can be noted at 87. This may be integrally formed, or structurally applied thereto, as by adherence of the flanges 88 to the opening 89 provided through the wall of the container 85. The inner end of the vent tube 86, has its vent port 90, arranged, once again, at the approximate volumetric midpoint of the shown container, in order to achieve the results and benefits of this invention.

Figure 25:
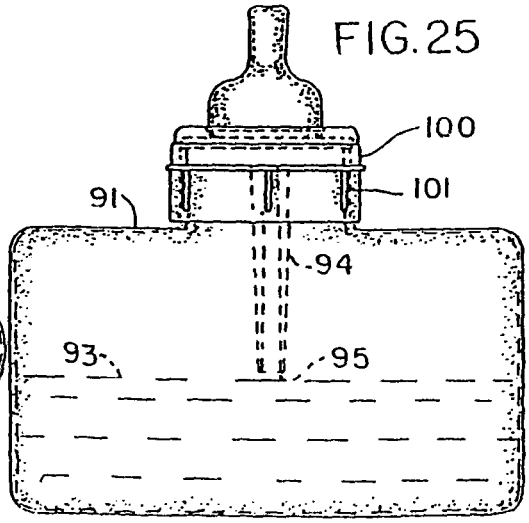
FIG. 25 is a front view of a further shaped vented nursing bottle of this invention.
Figure 26:
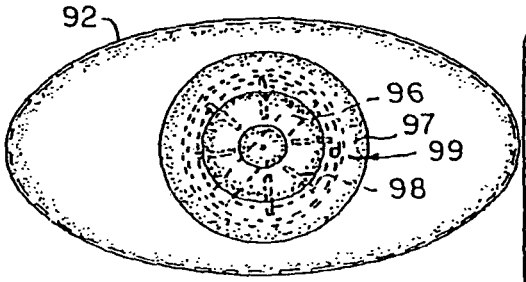
FIG. 26 is a top view of an oval shaped wide rim nursing bottle of this invention.

FIGS. 25 and 26 disclose a further modification to the nursing bottle of this invention, wherein its rectangularly configured container 91 has an oval appearance along the vertical, as can be noted in FIG. 26, as at 92.

It provides sufficient volumetric capacity so that the surface of the formula added thereto, as at 93, will always be below the vent tube 94, and its vent port 95, regardless of the position undertaken by the nursing bottle, when used. In accordance with the structure of the venting characteristics of this development, and as can be seen in FIG. 26, the vent tube 94 has lateral vents 96 that extend laterally to the sides of the vent insert 97, and which provides venting of any pressure or vacuum developed within the container 91 to the atmosphere, by passing through the configured threads 101, as can be understood from our prior patents.

As known from our prior development, the vent insert 97 includes a series of supporting vanes 98 that provide intermediate spacing, as at 99, and through which the formula may flow, when the nursing bottle is inverted, as during a feeding. But, the lateral vents 96 communicate with the vent tube 94, to allow passage of any pressure, or lack thereof, therethrough, and through said vents, to be discharged to atmosphere, by passing through the imperfect seal formed of the threaded connection between the collar 100, and the threads 101 of the wide rimmed structure of the container 91, of the shown nursing bottle. Nevertheless, the criticality regarding the location of the vent port 95, at the approximate volumetric midpoint of the shown container 91, is essential so as to prevent any blockage to it, when formula is applied therein, so that venting can effectively occur, regardless whether the nursing bottle is being used, stored, heated, or inverted, as during a feeding process.

Figure 27:
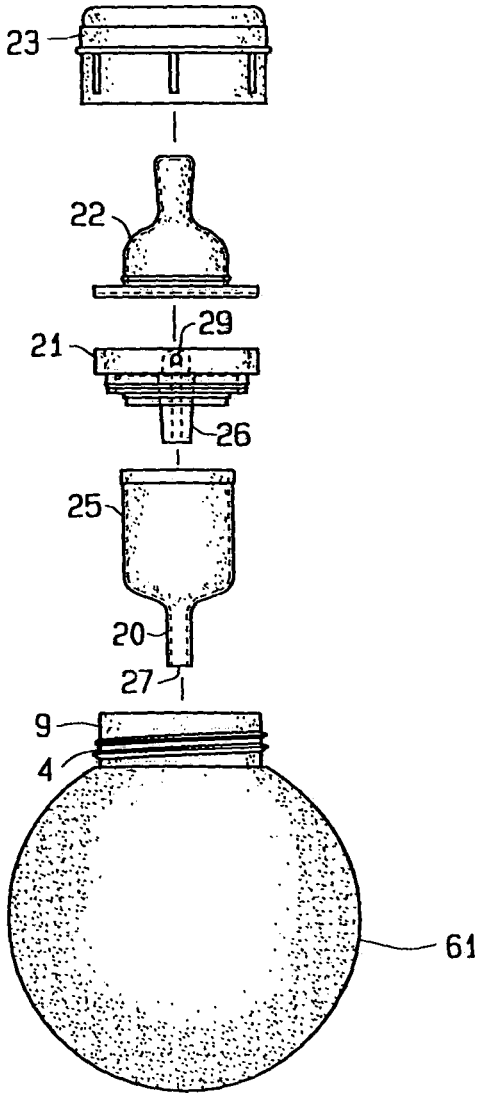
FIG. 27 is an exploded view of the operative components of the nursing bottle where the receptacle fits within a spherical container.

FIG. 27 provides an exploded view of the various operative components of the nursing bottle where the receptacle fits within a spherical container. The various components of this embodiment have already been previously described herein.

Figure 28:
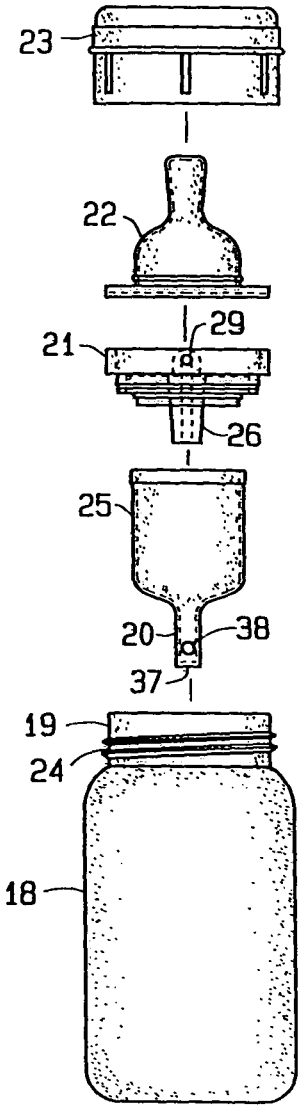
FIG. 28 is an exploded side view of the operative components of the nursing bottle showing its internal venting structure.

FIG. 28 provides a further exploded view of the operative components, as previously reviewed, of the nursing bottle 18 showing its internal venting structure.

Figure 29:
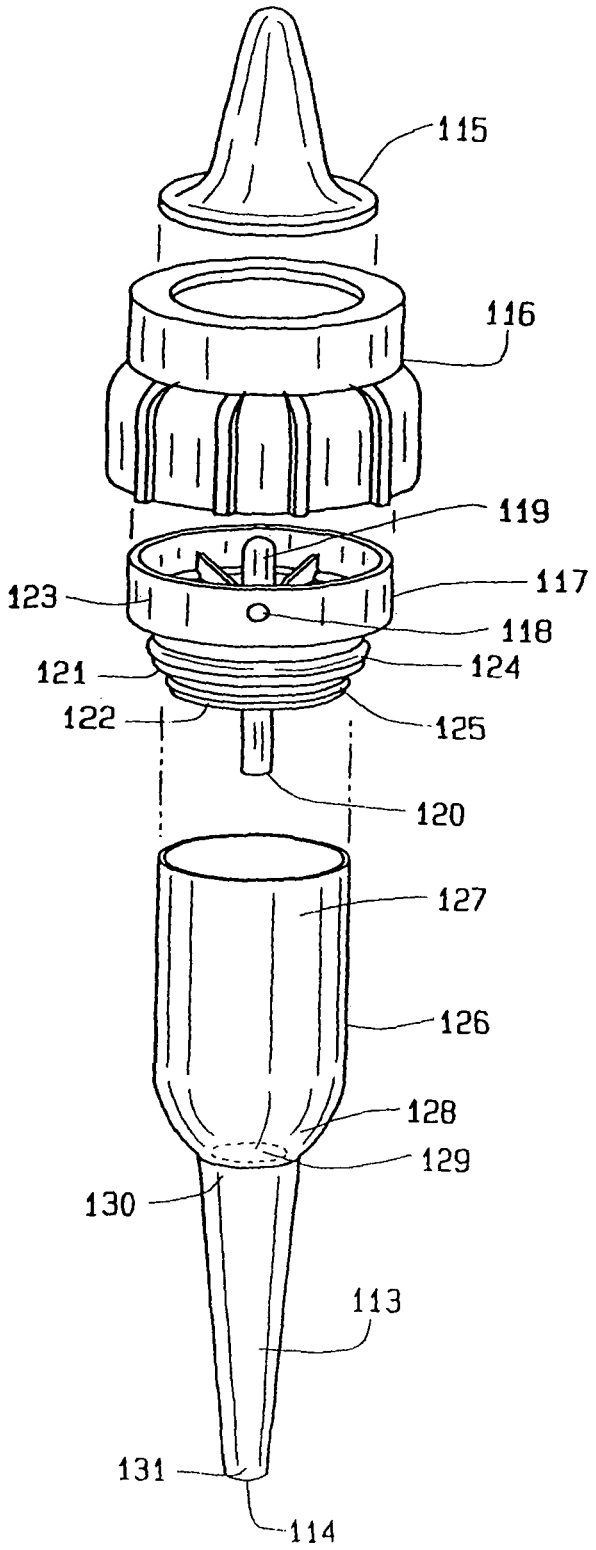
FIG. 29 is an exploded view of the vent tube of the present invention and appurtenant components.
Figure 29A:
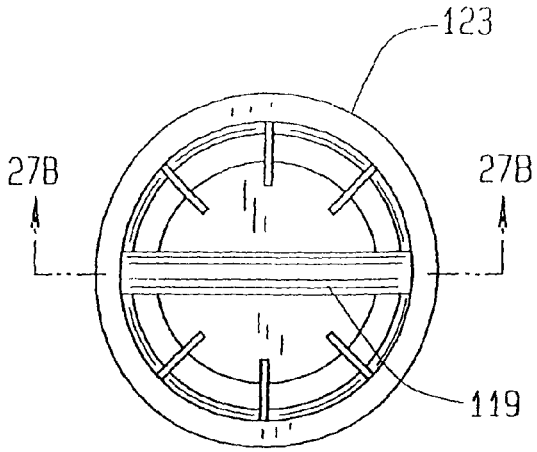
FIG. 29*a* is a top view of the vent insert.
Figure 29B:
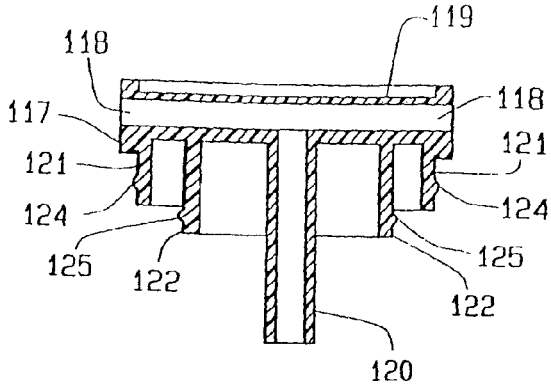
FIG. 29*b* is a sectional view of the vent insert.

The bottle components for this fully vented wide rim nursing bottle, and which also includes a contoured vent tube, is shown in FIG. 29. FIG. 29 shows an exploded view of the components less the liquid container or bottle. A nipple 115 extends out from a collar 116 that secures to the bottle 1. Between the collar and the bottle, a vent insert 117 grasps the rim of the bottle 1. The vent insert has a generally hollow cylindrical shape with a low height perimeter wall 123. Across the diameter, the vent insert 117 has a lateral vent 119 with a centered hole towards the direction of the bottle as shown in FIGS. 29*a*, 29*b*. The lateral vent has two opposed openings 118 the generally communicate air between the bottle 1 and the atmosphere. The insert 117 has a major lip 121 and a minor lip 122 concentric and slightly below the major lip 121 as then shown in FIG. 29B. Depending from the wall 123, the vent insert 117 has the major lip 121 also a hollow cylindrical shape contiguous but of slightly lesser diameter than the vent insert. In this manner, the vent insert can be applied in a tight seal within the rim of the bottle, during its installation, and thereby prevent any leakage from the vent insert other than the air venting desired from the structure of the insert and its applicability and usage in a nursing bottle. This aperture is provided at 114, for the contoured vent tube 113, shown in the preferred embodiment as conical though other shapes are possible. In addition, the bottom of the vent tube typically ends, in this instance, proximate to the internal bottom of any nursing bottle upon which the venting structure of this invention applies, regardless of whether it be the standard bottle, a wide rim bottle, or the like. The major lip has a circumferential bulge 124 of slightly larger diameter than the major lip. The bulge of the major lip seals the insert to the inner diameter of the bottle. The major lip has an outer diameter that of the inner diameter of the bottle.

Depending from the lateral vent 119, the vent insert 117 has the minor lip 122 as a hollow cylindrical shape of lesser diameter than the major lip. The minor lip 122 has a circumferential bulge 125 of slightly larger diameter than the minor lip. The minor lip has an outer diameter of the inner diameter of the reservoir. The minor lip seals the reservoir 126 of the vent tube of the present invention to the vent insert 117.

The vent tube 113 has a reservoir 126 having a generally hollow cylindrical shape with an open top 127 and a partially closed bottom 128. The bottom is smoothed and rounded as it descends distally from the top. At the center of the bottom 128, an aperture 129 provides passage to the vent tube 113 joined to the bottom. The vent tube then attains a hollow truncated conical shape with the larger diameter 130 located towards the reservoir 126 and the narrow diameter 131 located distally.

Coaxial with the vent tube 113, the vent insert 117 has the distal insert or internal vent tube 120 centered upon the hole in the lateral vent 119 and perpendicular to the lateral vent 119 opposite the insert wall 123. The internal vent tube 120 is a hollow cylinder of a length in excess of its diameter. The internal vent tube 120 communicates air, but not feeding liquid in the current invention, from the lateral vent 119 into the reservoir 126 of the vent tube 113.

Figure 30:
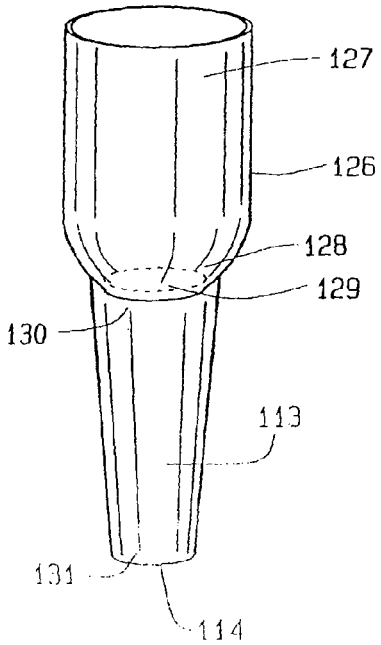
FIG. 30 is an isometric view of the vent tube having a large diameter proximally.

FIG. 30 shows the vent tube 113 alone and having a large diameter 130 proximate to and similar in diameter to the bottom 128 of the reservoir 126. The vent tube 113 then tapers distally towards the narrow diameter 131. In the preferred embodiment, the larger diameter 130 is approximately twice that of the narrow diameter 131, a ratio of about 2:1.

Figure 31:
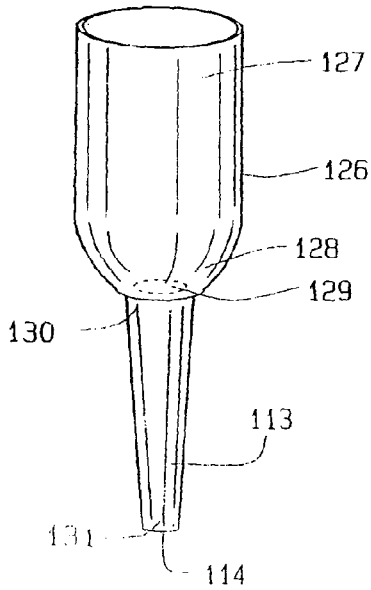
FIG. 31 is an isometric view of the vent tube having a narrow diameter proximally.

FIG. 31 again shows the vent tube 113 alone but with the larger diameter 130 substantially less than previous embodiments. In this embodiment, the larger diameter 130 attains at least one eighth more than the diameter of the narrow diameter 131. Towards the narrow diameter 131, the vent tube 113 tapers distally as before. In this embodiment, the large diameter 130 is slightly greater than the narrow diameter 131, a ratio of about 1.1:1.0.

Figure 32:
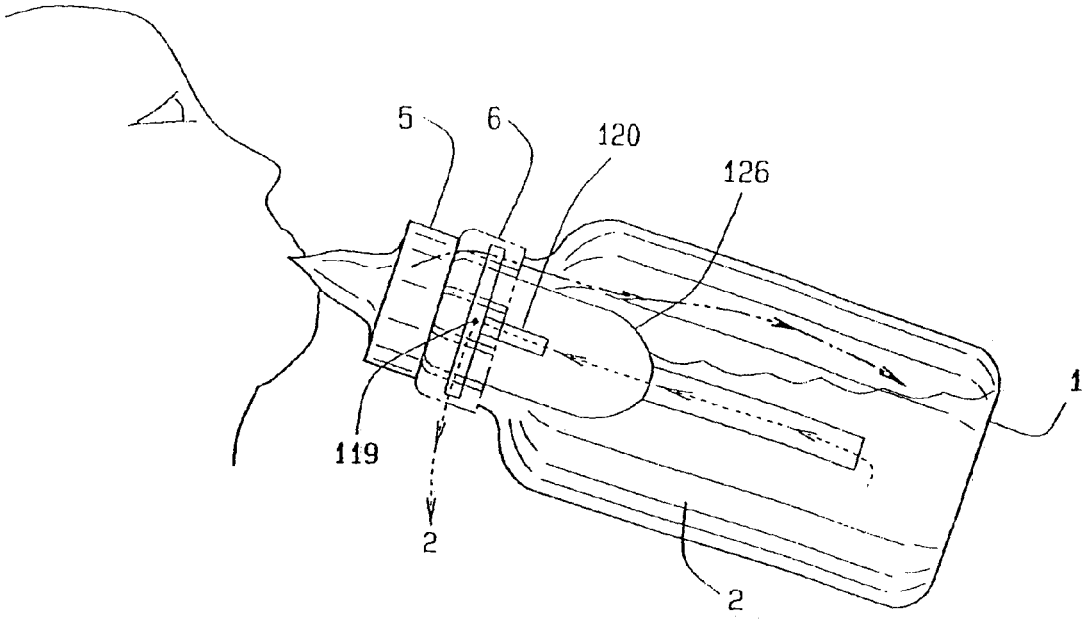
FIG. 32 PRIOR ART
FIG. 32 shows a vented bottle with a cylindrical tube and leakage during use by an infant.

FIG. 32 shows a prior art bottle in use by a chewing infant with the bottle lowered below a horizontal orientation for ready grasping by the infant. This bottle 1 has a cylindrical tube of constant diameter. With a down inclined bottle, the tube contacts the feeding liquid. When the nipple is quickly compressed, as during chewing, the compressed air above the liquid pressurizes the liquid briefly within the container. The compressed air advances from the nipple through the vanes of the insert and into the container, pressurizing it. The pressurized air forces the liquid up into the prior art vent tube having straight and constant diameter walls. The liquid in the vent tube suddenly and abruptly enters the insert where it exits the bottle through the lateral ports of the inserts. The liquid that has exited then leaks upon an infant or caregiver.

Figure 33:
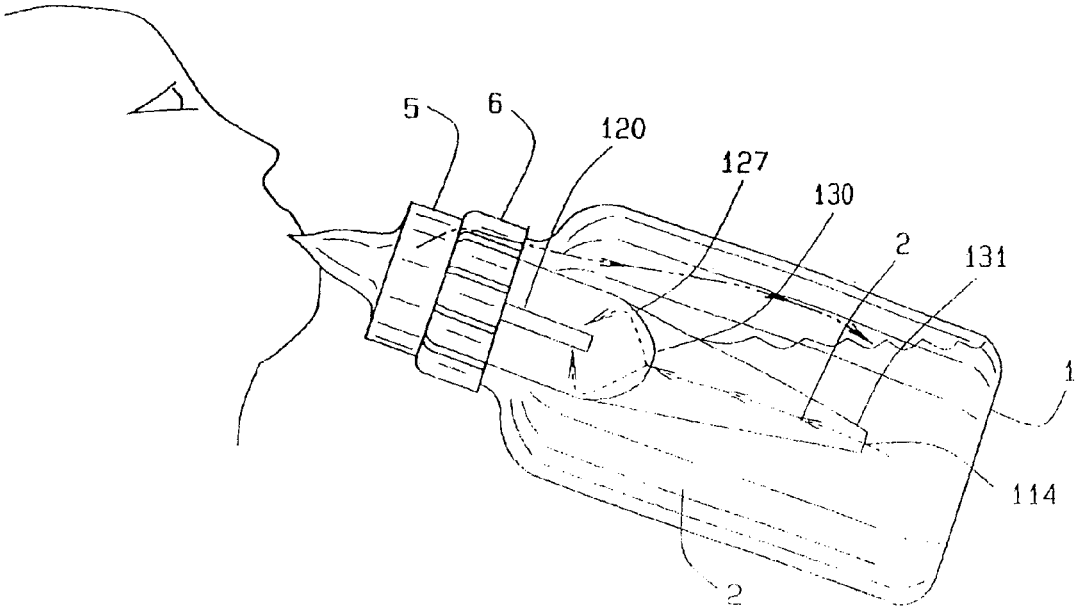
FIG. 33 shows a vented bottle with a tapering tube without a leak during use by an infant.

The tapered vent tube of the present invention, shown in FIG. 33, dissipates the feeding liquid induced into the vent tube. A contoured tube, particularly conical shaped, dissipates the pressure upon the liquid within the tube as the tube diameter expands and the feeding liquid gently flows into the reservoir instead of abruptly leaking out the vent ports as in the prior art. Where a bottle 1 in FIG. 33 has a vent tube of a conical shape and increasing diameter from the narrow distal end 131 to the wider proximal end 130, an infant chewing on the nipple 5 pressurizes the liquid 2 but the increasing diameter of the vent tube reduces the incremental volume inside the tube and deters feeding liquid 2 from exiting the bottle 1 at the insert 119 and leaking out of the collar 6. The increasing vent tube diameter limits any pressure increases within the bottle 1 and thus leaks from the bottle are prevented by the present invention.

From the aforementioned description, a fully vented wide rim, or other diameter, nursing bottle has been described. This nursing bottle is uniquely capable of reducing pressure increases within a vent tube and prevents leakage from the bottle. This nursing bottle and its various components may be manufactured from many different materials including but not limited to polymers, low density polyethylene, high density polyethylene, polypropylene, glass, nylon, ferrous and non-ferrous metals, their alloys, and composites.

Variations or modifications to the subject matter of this invention may occur to those skilled in the art upon reviewing the development as described herein. Such variations, if within the scope of this development, are intended to be encompassed within the principles of this invention, as explained herein. The description of the preferred embodiment in addition to the depiction within the drawings is set forth for illustrative purposes only.

We claim:

1. A wide-rim, fully vented nursing bottle adapted to be filled with liquid, wherein the bottle prevents a vacuum from being formed within the bottle when tilted or inverted during usage, and wherein the wide-rim of the bottle is facile of cleaning the bottle, the nursing bottle comprising:

a container having a wide-rim at an open top, the wide-rim having a diameter slightly less than the width of the container, and the container being adapted to contain a quantity of liquid therein, the container having a volumetric capacity;

a threaded collar, a nipple suitable for an infant feeding upon liquid from within said bottle, and a vent insert, said collar, said nipple and said vent insert cooperating and capable of application to the open top of the wide-rim container to provide venting to the interior of the nursing bottle when used, said vent insert provided for sealing upon the top of the wide-rim container and sealed therewith by the tightening of the threaded collar thereon, and said vent insert pressure fitting for sealing within the wide-rim of the container, an internal vent tube integrally extending downwardly from said vent insert, said vent insert having a lateral passage therethrough for venting to the atmosphere outside of said nipple between the threaded collar as applied to the container wide-rim, said vent insert further having a major lip and a minor lip, a vent receptacle portion adapted to be sealed to the vent insert and the minor lip, said internal vent tube having a lower end ending within said vent receptacle portion, a vent tube having an upper end integrally connecting with the vent receptacle portion and an opposite lower end terminating approximately at the bottom of said container such that when said container is maintained upright or inverted any liquid contained within the nursing bottle remains outside of said vent tube and below the bottom of said inverted integral vent tube within the vent receptacle portion;

said threaded collar, vent insert, and vent receptacle providing a double seal within the wide-rim of the nursing bottle, said vent tube has an opening port in the vicinity of its distal lower end, and said vent tube having a generally tapered shape;

an airway in the vent receptacle portion and through said internal vent tube and said vent insert and communicating the interior of the bottle to atmosphere when the nursing bottle is tilted or inverted during usage; and wherein the minor lip comprises a hollow cylindrical shape and the minor lip depends downwardly from the vent insert, said minor lip has a diameter, wherein the major lip comprises a hollow cylindrical shape and the major lip depends downwardly from the vent insert, the major lip has a diameter and the diameter of the major lip is greater than the diameter of the minor lip, the minor lip has a circumferential bulge on an exterior side of the minor lip with the bulge for receiving the vent receptacle portion for sealing the vent receptacle portion to the minor lip, and the major lip has a circumferential bulge on an exterior side of the major lip with the bulge for sealing the vent insert within an interior of the container.

2. The nursing bottle according to claim 1 wherein said collar, vent insert, and said internal vent tube are integrally structured.

3. The nursing bottle of claim 1 wherein said vent tube having a generally hollow contoured shape, a larger diameter of the contoured shape of said vent tube locating proximal to said reservoir, and a narrower diameter of the contoured shape of said vent tube locating distally from said reservoir and in proximity with the bottom end of said container, and said vent tube being centered upon said internal vent.

* * * * *

UNITED STATES PATENT AND TRADEMARK OFFICE

CERTIFICATE OF CORRECTION

PATENT NO. : 8,757,406 B2
APPLICATION NO. : 12/925465
DATED : June 24, 2014
INVENTOR(S) : Brown et al.

It is certified that error appears in the above-identified patent and that said Letters Patent is hereby corrected as shown below:

In the Specification
Column 1, lines 7-21 should read

This continuation-in-part claims priority to the continuation patent application having Serial No. 12/807,013, filed August 26, 2010, which claims priority to the continuation patent application having Serial No. 12/072,465, filed February 26, 2008, which claims priority to the continuation patent application having Serial No. 12/002,468, filed December 17, 2007, now Patent No. 7,828,165, which claims priority to the continuation patent application having Serial No. 11/258,966, filed on October 26, 2005, which claims priority to the nonprovisional patent application having Serial No. 10/283,878, which was filed on October 30, 2002, which claims priority to the PCT International patent application having Serial No. PCT/US01/14365, which was filed on May 4, 2001, which claims priority to the provisional patent application having Serial No. 60/202,851, which was filed on May 8, 2000.

Signed and Sealed this
Nineteenth Day of August, 2014

Michelle K. Lee

Michelle K. Lee
*Deputy Director of the United States Patent and Trademark Office*